United States Patent [19]

Vanover et al.

[11] Patent Number: 5,070,351

[45] Date of Patent: Dec. 3, 1991

[54] METHOD AND APPARATUS FOR PROCESSING PHOTOSENSITIVE MATERIAL

[75] Inventors: Joel L. Vanover, Elkton; Jon F. Boyer, Earleville, both of Md.; Douglas J. Hohlbein, Central Islip, N.Y.; Anthony P. Montalbano, Bayville, N.Y.; Christopher P. Montalbano, Great Neck, N.Y.; John G. Van Remoortel, Newark, Del.

[73] Assignee: E. I. Du Pont de Nemours and Company, Wilmington, Del.

[21] Appl. No.: 421,216

[22] Filed: Oct. 13, 1989

[51] Int. Cl.[5] ..... G03D 3/06

[52] U.S. Cl. ..... 354/299; 354/322; 354/324; 134/122 P; 141/346; 141/364

[58] Field of Search ..... 354/316, 320, 321, 322, 354/324, 323, 336; 222/132, 185; 141/346, 363, 364, 365, 366; 134/45 P, 122 P

[56] References Cited

U.S. PATENT DOCUMENTS

| | | | |
|---|---|---|---|
| 4,367,941 | 1/1983 | Uenaka et al. | 354/324 |
| 4,451,132 | 5/1984 | Kishimoto | 354/324 |
| 4,533,225 | 8/1985 | Shiga | 354/322 |
| 4,629,303 | 12/1986 | Vermarien | 354/320 |
| 4,641,940 | 2/1987 | Müller et al. | 354/322 |
| 4,641,941 | 2/1987 | Yoshimi | 354/324 |
| 4,719,173 | 1/1988 | Hahm | 430/398 |
| 4,734,728 | 3/1988 | Müller | 354/322 |
| 4,800,408 | 1/1989 | Yamada | 354/322 |
| 4,806,962 | 2/1989 | Uchida et al. | 354/324 |
| 4,814,809 | 3/1989 | De Prijcker et al. | 354/319 |
| 4,826,757 | 5/1989 | Yamada et al. | 430/428 |
| 4,829,330 | 5/1989 | Yamada et al. | 354/322 |

OTHER PUBLICATIONS

Copending U.S. Patent Appl. No. 07/316,656 (attorney case number IM-0142) filed Feb. 28, 1989 entitled "Low Wash Water Silver Halide Film Processor", invented by Daniel F. Juers.

*Primary Examiner*—A. A. Mathews

*Attorney, Agent, or Firm*—John E. Griffiths

[57] ABSTRACT

This invention relates to a method and apparatus for processing photosensitive material and, in particular, to a compact table top apparatus for developing silver halide photosensitive materials, such as a sheet or web of photographic film or paper or plate, and its use.

27 Claims, 12 Drawing Sheets

70
170
180
182
184
186
188
190
192
194
196
198
200
201
202
203
204
205
206
207
208
210

Fig. 10
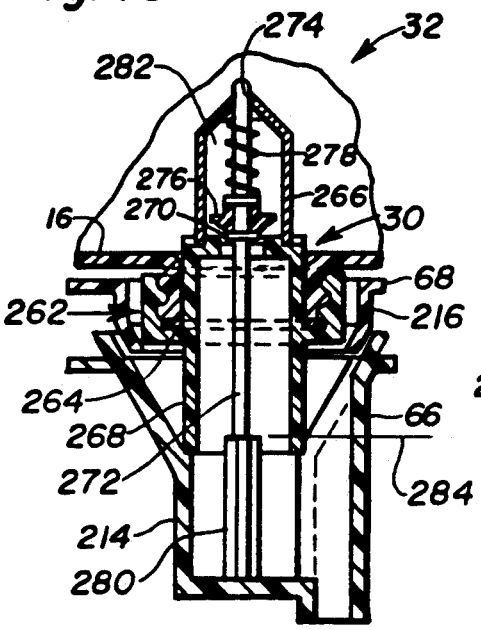
Fig. 11
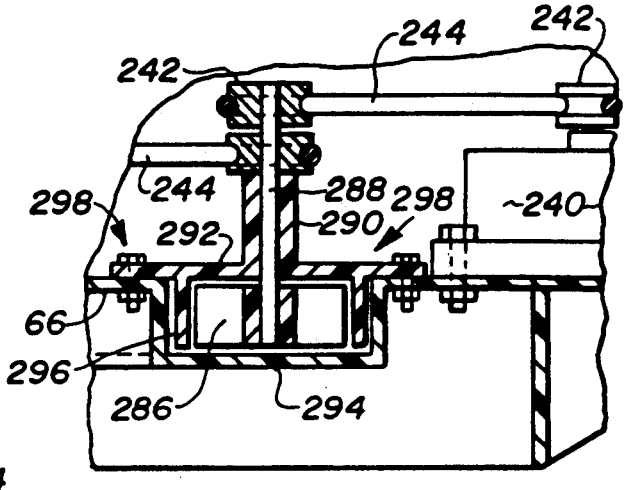
Fig. 12
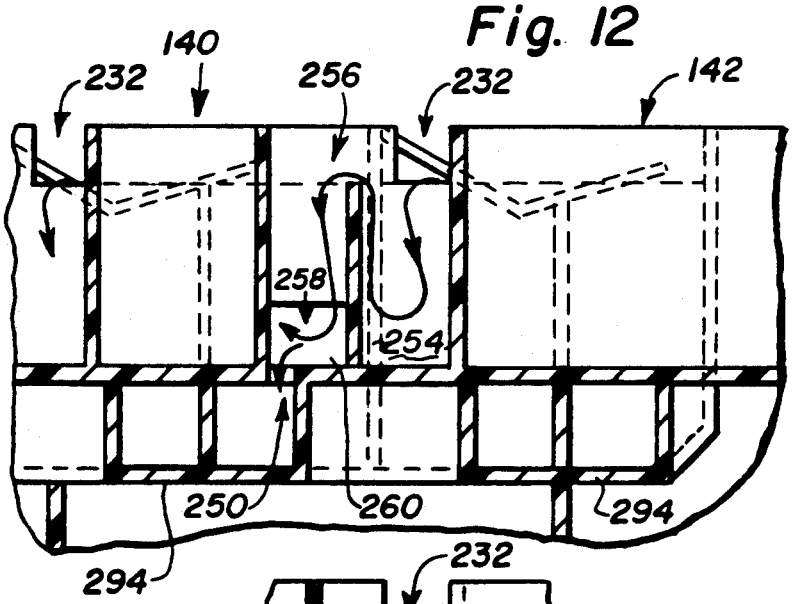
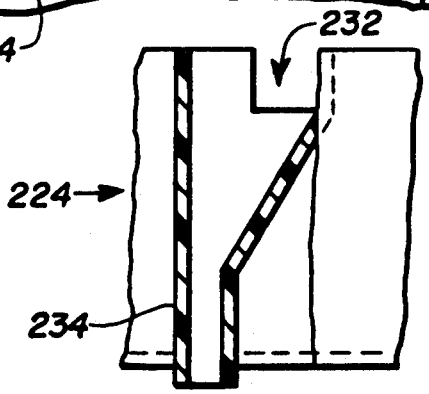
Fig. 13

METHOD AND APPARATUS FOR PROCESSING PHOTOSENSITIVE MATERIAL

BACKGROUND OF THE INVENTION

1. Field of the Invention

This invention relates to a method and apparatus for processing photosensitive material and, in particular, to a compact table top apparatus for developing silver halide photosensitive materials, such as a sheet or web of photographic film or paper or plate, and its use.

2. Description of Related Art

In order to record an image onto a photosensitive material, such as a sheet or web of photographic film or paper or plate, typically the photosensitive material is first imagewise exposed, for example, to actinic light or electromagnetic radiation. Then the exposed photosensitive material is fed into a developing apparatus. In the developing apparatus, the exposed photosensitive material is processed as it passes through a series of developing, fixing and washing tanks which are usually arranged consecutively. The developed material is then dried. This process results in the image being permanently recorded on the photosensitive material.

Automatic developing apparatuses generally are large units suitable for industrial or laboratory environments. This is due to the mechanical complexity in accommodating the photosensitive material for both physical transport and processing through multiple solutions as well as service and maintenance requirements of the units.

Transport of the photosensitive material through the series of tanks must be closely controlled in order to accurately develop a quality image on the material. The apparatus typically comprises a transport mechanism having a multiplicity of rollers, gears and guides which are sometimes grouped together as racks for easy submersion into the appropriate processing tank. In addition, the developing apparatuses generally comprise a multiplicity of pumps, valves, drains, etc., which control, for example, the fill, replenish and recycle of the various chemical solutions and water throughout the apparatus. As such, developing apparatuses are generally complex, difficult to maintain and cumbersome to service.

Frequently, the chemical solutions, such as the developer used in the developing tank and the fixer used in the fixing tank, are purchased concentrated and must be diluted typically with water and mixed by an operator for use in the apparatus. Mixing of the solutions can be messy, from spills and splashes, etc., but also, and more importantly, mixing of the solutions exposes those individuals working with the solutions to the potentially hazardous and/or toxic chemicals.

Further, once the activity of a chemical solution is exhausted, i.e., the degree of chemical activity of the developer and/or fixer is low enough so as not to produce a quality image on the photosensitive material, the solutions are discarded from the apparatus via a drain typically permanently fixed ultimately to municipal water system. Concerns for the ecological safety of the environment question the disposal of such chemical solutions in such a manner.

Also, the processing solutions, especially the developer and fixer solutions, are typically maintained at temperatures above room temperature, for example in the order of 85° to 120° Fahrenheit (F) (29.4° to 48.8° Celcius (C)). The elevated temperatures of the solutions in prior art apparatuses give off a considerable amount of heat and vapors into the room where the apparatus is located. Additionally, developing apparatuses generally require high wash water throughput rates to keep the water in the washing tank clean. However, supplying the washing tank with a large amount of washing water at all times is highly uneconomical, does not meet demands for saving of resources and results in permanently piping water to the apparatus. Thus, typical developing apparatuses must be permanently located within a facility because of its requirements for drain, ventilation and utility services.

Various developing apparatuses have been proposed to address one or more of the aforesaid shortcomings of existing developing apparatuses. One in particular is U.S. Pat. No. 4,734,728 which discloses an apparatus for processing sheet films in which a drawer compartment is provided with a drawer or drawers which house insertable parallel containers of various processing solutions. All the processing solutions, including developer, fixer and wash water are supplied to their respective tanks via independent conduits with a circulating pump between the tanks and the drawers. Exhausted or waste processing solutions are directed to empty containers via a second series of independent conduits. The containers or drawers are automatically connected to the conduit upon its insertion into the drawer compartment. This apparatus, however, still has the disadvantage of requiring a considerable amount of plumbing conduits necessary for the transfer of processing solutions to and from their respective drawers, tanks and containers. Further, while all solutions are basically contained within the apparatus while in fresh through exhausted stages, there was no indication of reduced effluent or wash water volumes from conventional units.

It is an objective of the present invention to provide an apparatus for developing photosensitive materials which is compact, portable, office compatible, easy to operate and maintain, with low consumption of processing solutions and with low effluents in a self contained manner in order to reduce the human exposure to processing solutions and the environmental impact of the apparatus' operation.

It is an object of the present invention to provide a compact, table top, photographic film and paper processor that uses a reduced amount of replenishment and effluent of developer, fixer and water to allow this unit to be in an office environment versus the usual laboratory or industrial environment.

It is an object of the present invention to provide an apparatus capable of processing photosensitive material, such as a sheet or web of photographic film or paper, that does not require the water and drain services usually necessary for conventional photographic film and paper processors.

Further, it is an object of the present invention to provide an automatic photographic film and paper processor that uses pre-mixed chemistry cartridges and waste handling methods to eliminate chemical mixing and disposal methods currently required.

SUMMARY OF THE INVENTION

The present invention relates to an apparatus for processing a sheet or web of photosensitive material comprising:

means for holding process developer solution;

means for holding process fixer solution;

a wash system comprising a plurality of wash stations including a first and a last station and means for directing wash solution through the plurality of wash stations in a countercurrent arrangement to the direction of material transport for washing the material;

a dryer for drying the material;

means for transporting the material in order through the process developer solution when the process developer solution is in the first holding means, the process fixer solution when the process fixer solution is in the second holding means, the process wash solution when the process wash solution is in the plurality of wash stations and the dryer;

first means for holding and supplying replenishment developer solution to the first holding means;

second means for holding and supplying replenishment fixer solution to the second holding means; and third means for holding and supplying replenishment wash solution to the last station of the wash system, wherein the volume of replenishment wash solution supplied to the wash system comprises no more than about 50 milliliters per square foot of material processed by the apparatus.

The present invention further relates to a method of processing a sheet or web of photosensitive material comprising:

transporting the material through a bath of developer solution. a bath of fixer solution and a plurality of baths of wash solution including a first wash bath and a last wash bath;

circulating the wash solution through the plurality of baths of wash solution in a countercurrent arrangement to the direction of material transport; and supplying replenishment wash solution to the last wash bath such that the volume of replenishment wash solution supplied comprises no more than about 50 milliliters per square foot of material processed.

The present invention is further directed to a liquid replenishment system for supplying replenishment solutions to maintain a plurality of separate process solutions at predetermined levels, the system comprising:

a plurality of cartridges for holding a plurality of separate replenishment solutions; and a plurality of means for supplying one of the replenishment solutions to a corresponding one of the plurality of process solutions; and a support for supporting the plurality of cartridges in respective supported positions, the support having means for aligning and positioning that allows each of the plurality of cartridges only into its respective supported position.

The present invention is further directed to a wash system for washing chemicals off a sheet or web of material with a wash solution, the system comprising:

a first wash tank having a drain;

a second wash tank having a first overflow weir;

means for transporting the material through wash solution in the first tank and then the second wash tank;

means for directing the wash solution in order through the second tank, over the second tank overflow weir, the first tank and the drain; and means for replenishing wash solution to the second tank at no more than about 50 milliliters per square foot of material washed.

BRIEF DESCRIPTION OF THE DRAWINGS

The invention can be more fully understood from the following detailed description thereof in connection with accompanying drawings which form a part of this application and in which:

FIG. 10 is a detailed sectional view taken on the line 10—10 of FIG. 9 showing a chicken feeder cap.

FIG. 11 is a detailed sectional view taken on the line 11—11 of FIG. 9 showing a recirculating pump rotor assembly.

FIG. 12 is a detailed sectional view taken on the line 12—12 of FIG. 9 showing how the fluid level in a third wash tank is maintained and feeds into a second wash tank.

FIG. 13 is a detailed sectional view taken on the line 13—13 of FIG. 9 showing an overflow drain or outlet from the developer tank.

DESCRIPTION OF THE PREFERRED EMBODIMENT(S)

Figure 1:
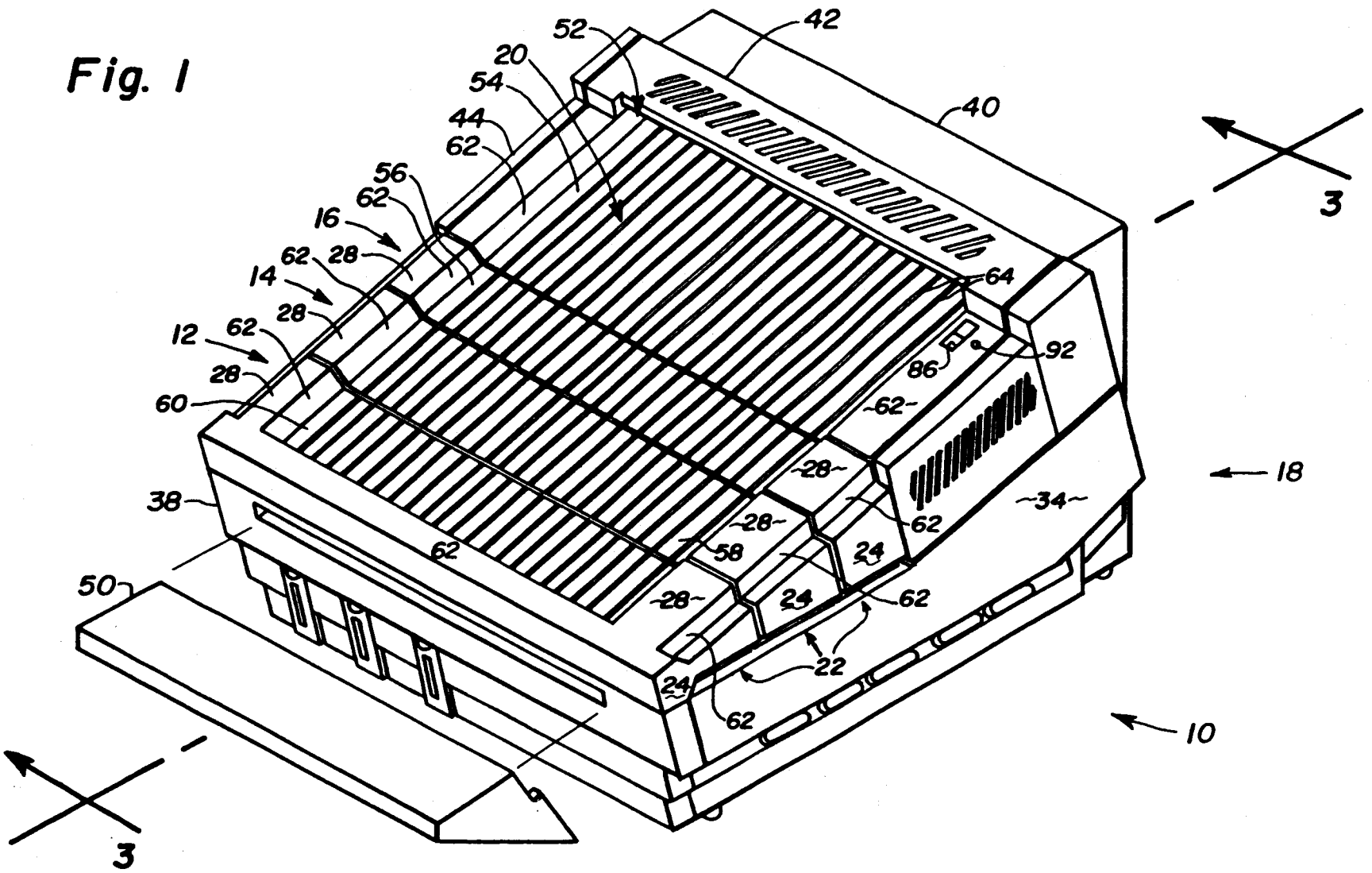
FIG. 1 is a perspective view of an apparatus for processing photosensitive material in accordance with the present invention.

Throughout the following detailed descripton, similar reference numerals refer to similar elements in all Figures of the drawings.

Figure 2:
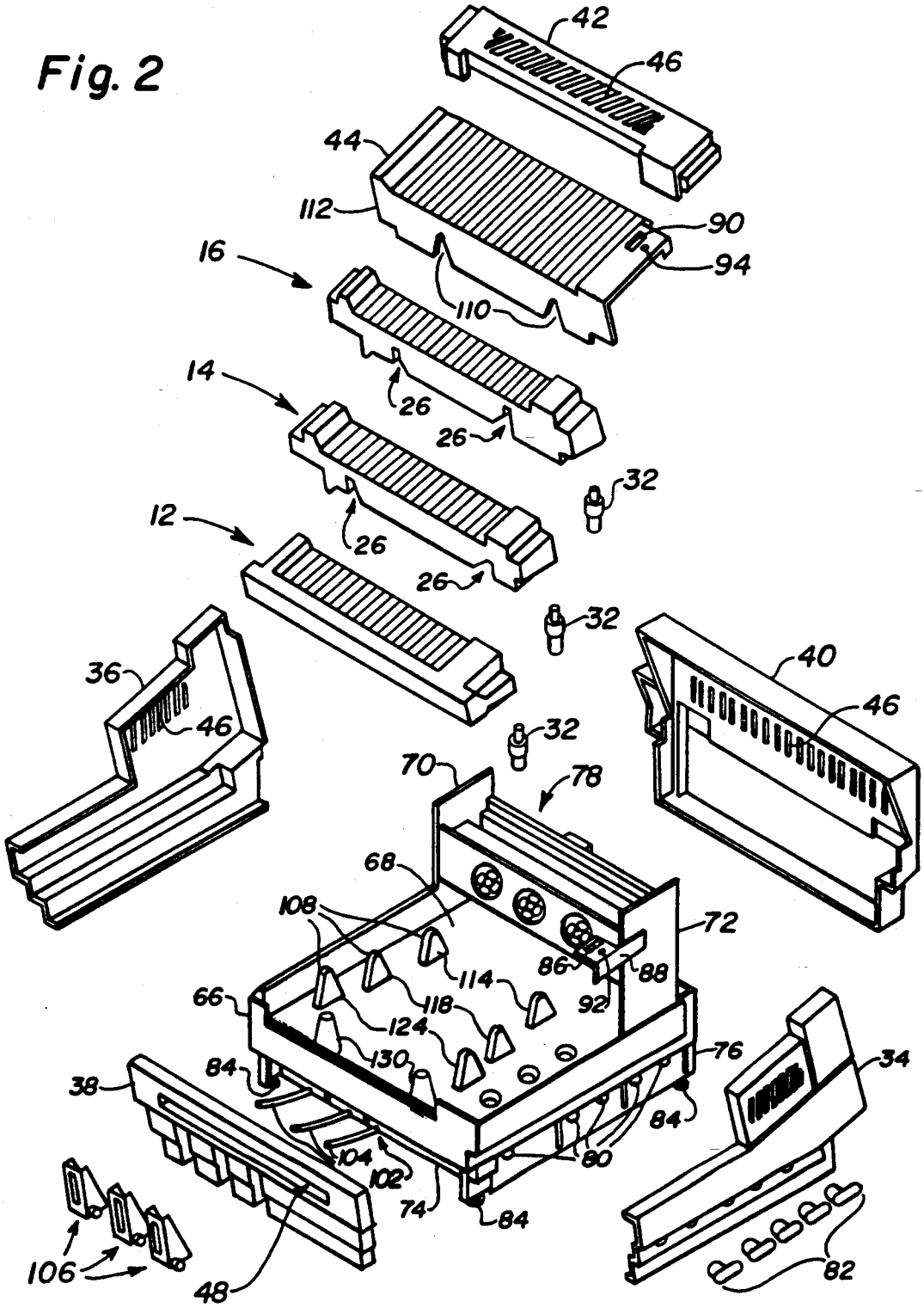
FIG. 2 is an exploded view showing components of the apparatus illustrated in FIG. 1.

Referring to FIG. 1, there is illustrated a perspective view of an automatic apparatus or processor 10 for processing photosensitive material in accordance with the present invention. The apparatus is capable of automatically developing a sheet or web of photosensitive material, such as silver halide film or paper. FIG. 2 is an exploded view showing components of the apparatus illustrated in FIG. 1.

The apparatus 10 includes a developer solution cartridge 12, a fixer solution cartridge 14 and a wash solution cartridge 16. The cartridges 12, 14, 16 are easily removable so that they can be refilled or replaced with replacement cartridges filled with desired chemistries.

The developer, fixer and wash solution cartridges 12, 14, 16 preferably comprise substantially 9 liter blow molded containers that are designed to mount on or connect to cartridge receiving positions of the processor 10 in a way that permits each of the cartridges 12, 14, 16 to mount on the remainder of the apparatus 10 in only one predetermined position. The developer and fixer cartridges 12 and 14, respectively, are used to package pre-diluted developer and fixer solutions, respectively, which eliminates the need for end users to mix and be exposed to caustic chemistries. The cartridges 12, 14, 16 are multi-functional. In addition to holding developer, fixer or wash solution, each cartridge is part of an exterior or housing 18 of the processor 10; each cartridge acts as part of a receiving tray 20 for processed films; and each cartridge is at least partially transparent and, thus, acts as a level indicator device to monitor the need for additional solutions and draining of effluent. The cartridges 12, 14, 16 have ergonomic handles 22 on two distal ends 24 for two hand manipulation of the filled container (which can weigh about 20 pounds) to and from the remainder of the processor 10. The cartridges 12, 14, 16 have indentations 26 that allow them to align themselves with the remainder of the processor 10 so that they can free fall into their predetermined cartridge receiving positions. Each cartridge is designed such that it can only be connected to one cartridge receiving position and not allow placement in any other cartridge receiving position. The cartridges 12, 14, 16 are conveniently shaped to be positioned immediately adajacent to at least one other of the cartridges for compact packaging. Further, each cartridge has at least one substantially flat surface 28 on a side substantially opposite an opening 30 into the cartridge such that the flat surface 28 can be conveniently set on a horizontal surface in order to connect a chicken feeder cap 32 to the opening 30 or refill the cartridge through the opening 30.

As seen in FIG. 2, the housing or exterior 18 has portions that are visible to an operator comprising a right side cover 34, a left side cover 36, a front side cover 38, a rear side cover 40, a top dryer cover 42, a film guide panel 44 and sides of the developer cartridge 12, the fixer cartridge 14 and the wash cartridge 16.

Ventilation slots 46 are present in the housing 18, such as in the right side cover 34, the left side cover 36, the rear cover 40 and the top dryer cover 42. The ventilation slots 46 permit air to be drawn into the apparatus 10 through some of the slots 46 to be used in drying the photosensitive material and then blown out through the remainder of the ventilation slots 46.

The front cover 38 has a feed slot 48 for receiving or inputting the photosensitive material. A feed tray 50 may be attached adjacent the feed slot 48 to facilitate positioning of the photosensitive material during the process of inserting the photosensitive material into the feed slot 48. See FIG. 1.

An exit slot 52 is defined between the top dryer cover 42 and the film guide panel 44. After photosensitive material is processed by the apparatus 10, the material is transported through the exit slot 52 onto the receiving tray 20. The receiving tray 20 comprises a surface 54 of the film guide panel 44, a surface 56 of the wash cartridge 16, a surface 58 of the fixer cartridge 14 and a surface 60 of the developer cartridge 12. The surfaces 54, 56, 58 and 60 are bordered by raised portions 62 in the film guide panel 44, and the cartridges 12, 14, 16. When the apparatus 10 is positioned for operation on a substantially flat surface, such as on a desk or a table, the surfaces 54, 56, 58 and 60 lie substantially in a single plane inclined from horizontal such that when developed material is transported out of the exit slot 52, the material slides down the inclined surfaces 54, 56, 58 and 60 being guided by the bordering raised portions 62 until the material is stopped by one of the raised portions 62 on the developer cartridge 12 across a top front edge of the apparatus 10. The surfaces 54, 56, 58 and 60 can have a plurality of substantially parallel ridges 64 running from the exit slot 52 to the raised portion 62 across the top front edge of the apparatus 10 to facilitate sliding of the material along the surfaces 54, 56, 58 and 60. The flat surfaces 28 may be on the raised portions 62.

As seen in FIG. 2, the apparatus 10 has interior components including a processing tray 66, a cartridge support and tank cover 68 positioned on the processing tray 66, a left drive side plate 70 supported by the processing tray 66, a right side plate 72 supported by the processing tray 66, a drain cartridge 74 positioned under the processing tray 66, a rear foot member 76 defining an electrical box connected to the rear of the processing tray 66, a dryer 78 positioned on the electrical box, a chicken feeder cap 32 for each of the cartridges 12, 14, 16, five three-way valves 80 with their associated handles 82, leveling feet 84 connected to the processing tray 66 at each front corner of the apparatus 10 and leveling feet 84 connected to the rear foot member 76 at each rear corner of the apparatus 10.

The apparatus 10 has a switch 86, such as a rocker switch, for turning power on and off. The switch 86 can be mounted on an extension of the right side plate 72 or on a bracket 88 connected, for instance, to the right side plate 72, and can extend through a hole 90, such as, in one of the raised portions 62 of the film guide panel 44. Means for indicating 92 that the apparatus is ready for operation, such as a light emitting diode (LED) can also be mounted on the bracket 88 and extend through a hole 94 in the housing 18, such as in the film guide panel 44.

The drain cartridge 74 may be divided into three compartments 96, 98, 100 or may be three separate containers such that used or waste developer solution can be channeled to and stored in a first one 96 of the compartments, used or waste fixer solution can be sent to and stored in a second one 98 of the compartments and used or waste wash solution can be put in a third one 100 of the compartments. Each of the compartments 96, 98, 100 has an exit port 102 connected to a first end of a flexible, at least partially transparent, line 104. The second end of the lines 104 are connected to drain members 106 that are pivotably connected to the front cover 38. When the drain members 106 are "closed", they are and substantially vertical and the second ends of the lines 104 are positioned above the highest possible liquid level in the corresponding compartments. When the drain members 106 are pivoted such that the second ends of the lines 104 become lower than the liquid level in the corresponding compartment, then the liquid drains from the corresponding compartment through the drain member 106. The drain members 106 combined with the flexible lines 104 can be referred to as drain spouts. The lines 104 are visible through the drain spouts from the front of the apparatus 10 so that the height of the waste solutions in the compartments 96, 98 and 100 can be monitored by viewing the height of solution in the lines 104. The drain cartridge 74 and its three compartments 96, 98 and 100 comprise means for separately collecting waste developer solution, waste fixer solution and waste wash solution beneath the first process developer solution holding means 134, the second process fixer solution holding means and the wash system.

The cartridge support and tank cover 68 has cartridge locating pylons or protrusions 108 for positioning in the indentations 26 in the bottom of the cartridges 12, 14, 16 and notches 110 in a wall 112 of the film guide panel 44 that extends down from its top surface 54. A first pair 114 of the protrusions 108 extends in the notches 110. The first pair 114 of the protrusions 108 also extends into a corresponding first pair 116 of the indentations 26 in a lower rear edge of the wash cartridge 16. A second pair 118 of the protrusions 108 extends into a corresponding second pair 120 of the indentations 26 in a lower front edge of the wash cartridge 16 and into a corresponding third pair 122 of the indentations 26 in a lower rear edge of the fixer cartridge 14. A third pair 124 of the protrusions 108 extends into a corresponding fourth pair 126 of the indentations 26 in a lower front edge of the fixer cartridge 14 and into a corresponding fifth pair 128 of indentations 26 in a lower rear edge of the developer cartridge 12. A fourth pair 130 of the protrusions 108 extends into a corresponding sixth pair 132 of the indentations 26 generally in the middle of a bottom service of the developer cartridge 12. Each pair of the indentations 26 are offset or shaped differently with respect to the other protrusions 108 and corresponding pair of the pairs of the protrusions 108 and the indentations 26 to permit each of the cartridges to mount on the cartridge support and tank cover 68 in only one predetermined cartridge receiving position. This prevents an operator from accidentally connecting, for instance, developer solution in the developer cartridge 12 where the fixer cartridge 14 should be mounted.

Figure 3:
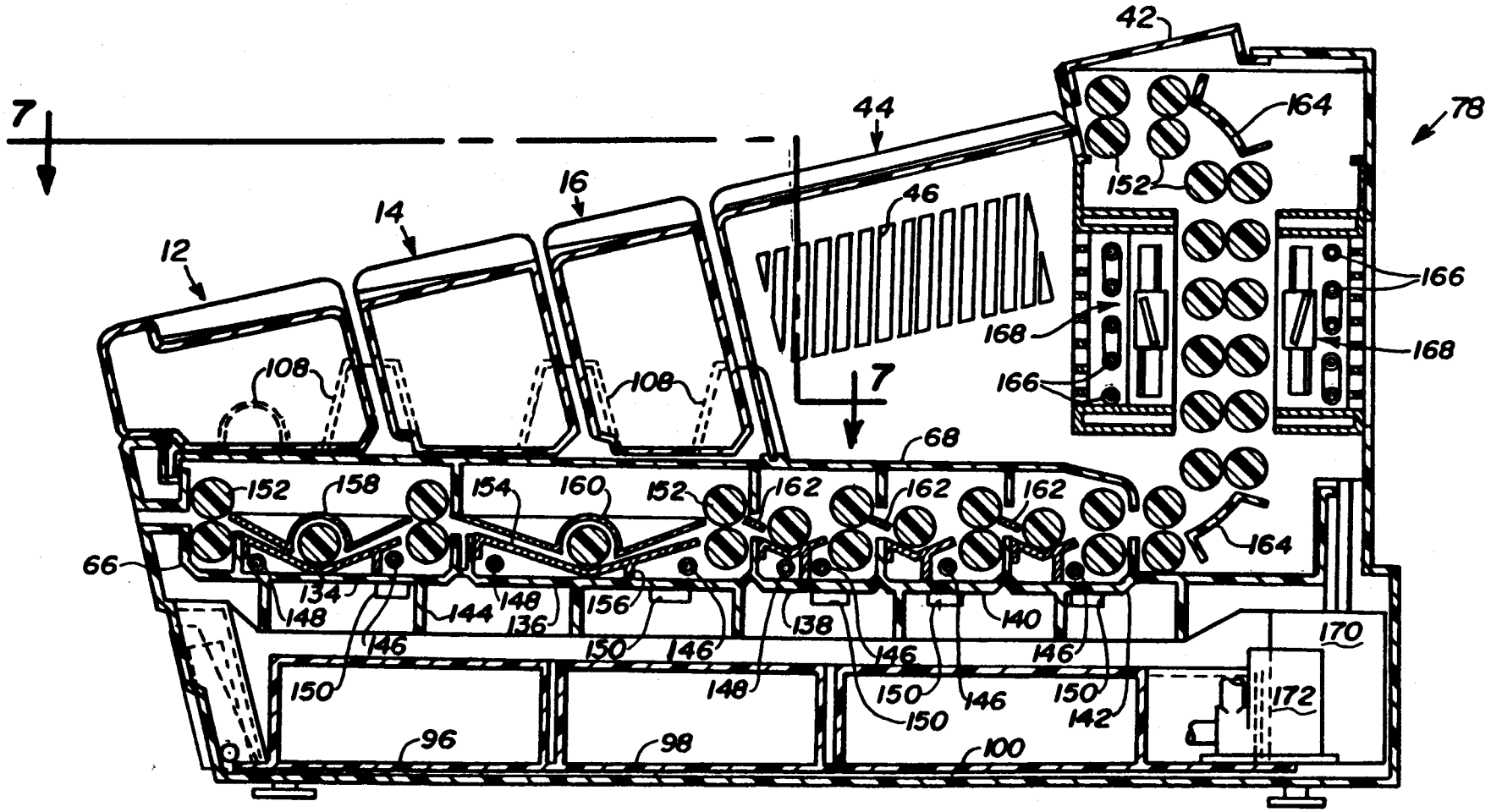
FIG. 3 is a vertical sectional view through a central part of the apparatus from front to back as indicated by the line 3—3 of FIG. 1.

FIG. 3 is a vertical sectional view through a central part of the apparatus 10 from front to back as indicated by the line 3—3 of FIG. 1. FIG. 3 illustrates, in section, the cartridges 12, 14, 16 positioned on the locating pylons 108. FIG. 3 further shows that the processing tray 66 defines a developer solution tank or bath 134, a fixer solution tank or bath 136, a first wash solution tank, stage, bath or station 138, a second wash solution tank, stage, bath or station 140 and a third wash solution tank, stage, bath or station 142. The developer solution tank 134 is means for holding process developer solution. The fixer solution tank 136 is means for holding process fixer solution. The processing tray 66 may also include support beams 144 positioned under the tanks running across the width, length and/or diagonally of the processing tray 66.

A heating element 146 is positioned in each one of the developer tank 134, the fixer tank 136, the first wash tank 138, the second wash tank 140 and the third wash tank 142. A temperature sensor and controller assembly 148 is positioned in the developer tank 134, the fixer tank 136 and the first wash tank 138. The temperature sensor and controller assemblies 148 control the operation of the heating elements 146. An overtemperature switch 150 is connected to the bottom of the processing tray 66 substantially beneath each of the heating elements 146. The overtemperature switches 150 turn their associated heating elements 146 and/or the entire processor 10 off if the temperature sensed exceeds a predetermined limit. The heating elements 146 and the temperature sensor and controller assemblies 148 comprise means for heating the process developer solution when the process developer solution is in the first holding means 134, the process fixer solution when the process fixer solution is in the second holding means 136, and the process wash solution when the process wash solution is in the plurality of wash stations 138, 140, 142.

The location of the developer, fixer and wash replenishment solutions in the cartridges 12, 14 and 16 provides preheating of the solutions by radiant heat from the processing solution baths in the tanks 134, 136, 138, 140 and 142 located directly under the replenishment cartridges 12, 14 and 16.

Material conveying rollers 152 are supported between the left drive side plate 70 and the right side plate 72. Lower material guide plates 154 with depending flow baffles 156 are positioned in each of the tanks 134, 136, 138, 140 and 142. The baffles 156 define the liquid circulating paths in the tanks 134, 136, 138, 140 and 142. An upper developer guide plate 158 is positioned above and spaced from the lower guide plate 154 in the developer tank 134. The upper developer guide plate 158 covers the developer tank 134 and one of the conveying rollers 152 positioned to cause the material to travel through developer solution in the developer tank 134. The upper developer guide plate 158 minimizes or reduces evaporation and oxidation of the developer solution by minimizing or reducing the area of the interface between the air and the developer solution in the developer tank 134. Similarly, an upper fixer guide plate 160 is positioned above and spaced from the lower guide plate 154 in the fixer tank 136. The upper fixer guide plate 160 covers the fixer tank 136 and one of the conveying rollers 152 positioned to cause the material to travel through fixer solution in the fixer tank 136. The upper fixer guide plate 160 similarly minimizes or reduces evaporation of the fixer solution by minimizing or reducing the area of interface between the air and the fixer solution in the fixer tank 136. Upper guide plates 162 are also positioned above portions of the wash tanks 138, 140 and 142. Other guide plates 164 are positioned to direct the material through the dryer 78.

Referring to FIG. 3, the dryer 78 comprises one or a plurality of heating elements 166 positioned on both sides of the material travel path. The dryer 78 further comprises a plurality of blowers 168 preferably positioned between the heating elements 166 and the material travel path. The blowers 168 draw air in through the ventilation slots 46 in the side covers 34, 36 and the rear cover 40. This air is combined with some recirculated air within the dryer 78. The blowers 168 draw the combined air past the heating elements 166 and blow the heated air on the material being transported by the rollers 152 through the dryer 78. Exhaust air is blown out of the apparatus 10 through the ventilation slots 46 in the top dryer cover 42 and the exit slot 52.

FIG. 3 further illustrates a drive gear motor 170 for driving the conveying rollers 152. It also shows a pump 172, such as a positive displacement or metering pump, for replenishing solutions in the tanks 134, 136, 138, 140 and 142.

Figure 4:
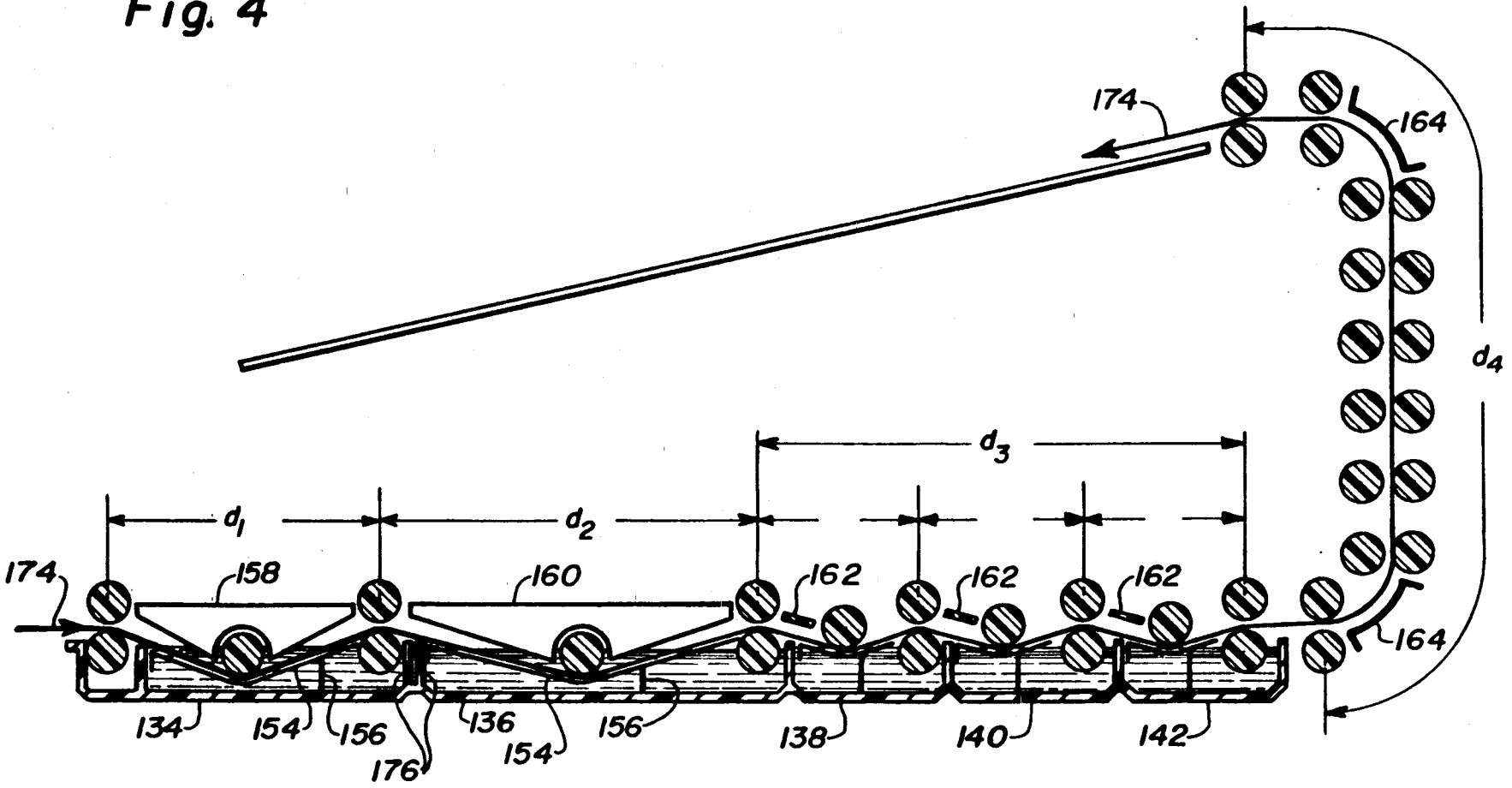
FIG. 4 is a simplified schematic view illustrating the material path of travel through the apparatus of the present invention.

FIG. 4 is a simplified schematic view illustrating the material path 174 of travel through the apparatus 10. FIG. 4 further illustrates that there may be double walls 176, defining on overflow channel 178 between the double walls 176, between the developer tank 134 and the fixer tank 136. This prevents solution from one of the tanks contaminating the solution in the other tank.

Through the use of the heating elements 146 and the temperature assemblies 148, the processor 10 is preferably capable of maintaining the developer solution from 90° to 110° Fahrenheit (F) plus or minus 1° F., the fixer solution from 90° to 110° F. plus or minus 2° F., the wash solution from 90° to 110° F. plus or minus 5° F., and the blown air from 90° to 140° F. plus or minus 5° F. Referring to FIG. 4, through the use of means for transporting material through the apparatus 10, the processor is preferably capable of providing immersion times of from 20 to 60 seconds plus or minus 1 second in the developer solution provided in the distance $d_1$, from 24 to 72 seconds plus or minus 1 second in the fixer solution provided in the distance $d_2$, from 34 to 101 seconds plus or minus 1 second in the wash solution provided in the distance $d_3$, and from 42 to 128 seconds plus or minus 1 second in the dryer 78 provided in the distance $d_4$.

Preferably, film or paper is processed at a through-put rate of 2 minutes and 30 seconds from dry undeveloped film or paper to dry developed film or paper. Preferred process conditions that achieve or permit the 2 minutes and 30 seconds total through-put rate are as follows. The film or paper can be immersed in developer solution for 25 seconds at 100° F., in fixer solution for 30 seconds at 85° to 100° F., in wash solution for 42 seconds at 100° F., and then blown by air for 53 seconds at 120° F.

Figures 5, 6:
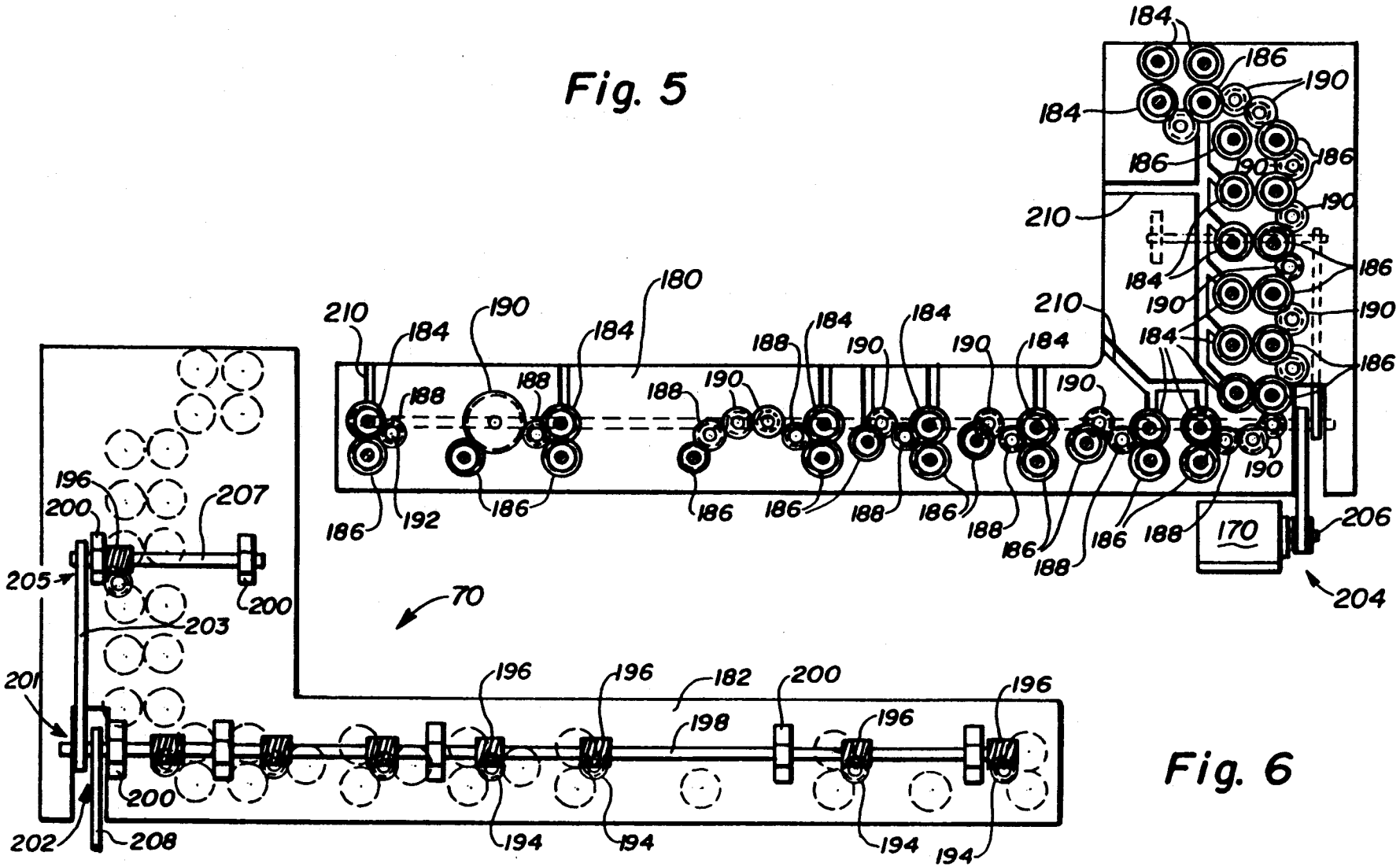
FIG. 5 shows an inner side of the left drive plate showing how motion is transmitted to each of the conveying rollers in accordance with the present invention.
FIG. 6 shows an outer side of the left drive plate showing how motion is transmitted to each of the conveying rollers in accordance with the present invention.

FIGS. 5 and 6 show opposite, i.e., inner and outer, side surfaces 180 and 182, respectively, of the left drive side plate 70 showing how motion is transmitted to each of the conveying rollers 152. FIGS. 5 and 6 illustrate one embodiment of means for transporting the material in order through the process developer solution when the process developer solution is in the first holding means 134, the process fixer solution when the process fixer solution is in the second holding means 136, the process wash solution when the process wash solution is in the plurality of wash stations 138, 140, 142 and the dryer 78. The conveying rollers 152 comprise idler rollers 184 and drive rollers 186. The conveying rollers 152 position the material in its travel path 174. The idler rollers 184 rotate due to frictional contact with the drive rollers 189 and/or the material being transported by the drive rollers 186. The drive rollers 186 are connected to spur gears 188 or idler gears 190 which are connected to spur gears 188. The spur gears 188 are on ends of shafts 192 which pass through the left drive side plate 70. Helical drive gears 194 are on the other ends of the shafts 192. The helical drive gears 194 are connected to worm drive gears 196 on a shaft 198 journaled to the left drive side plate 70 by bearing caps 200. A pulley 202 is on the shaft 198. The pulley 202 is connected to a pulley 204 on a shaft 206 of the drive gear motor 170 by a belt 208. Another pulley 201 on the shaft 198 is connected by a belt 203 to a pulley 205 on another shaft 207 connected to the side plate 70 by bearing caps 200. One of the worm drive gears 196 is on this shaft 207 for driving rollers 152 in the dryer 78.

FIG. 5 further shows roller registration slots 210 for positioning and supporting ends of the rollers 152.

Figure 7:
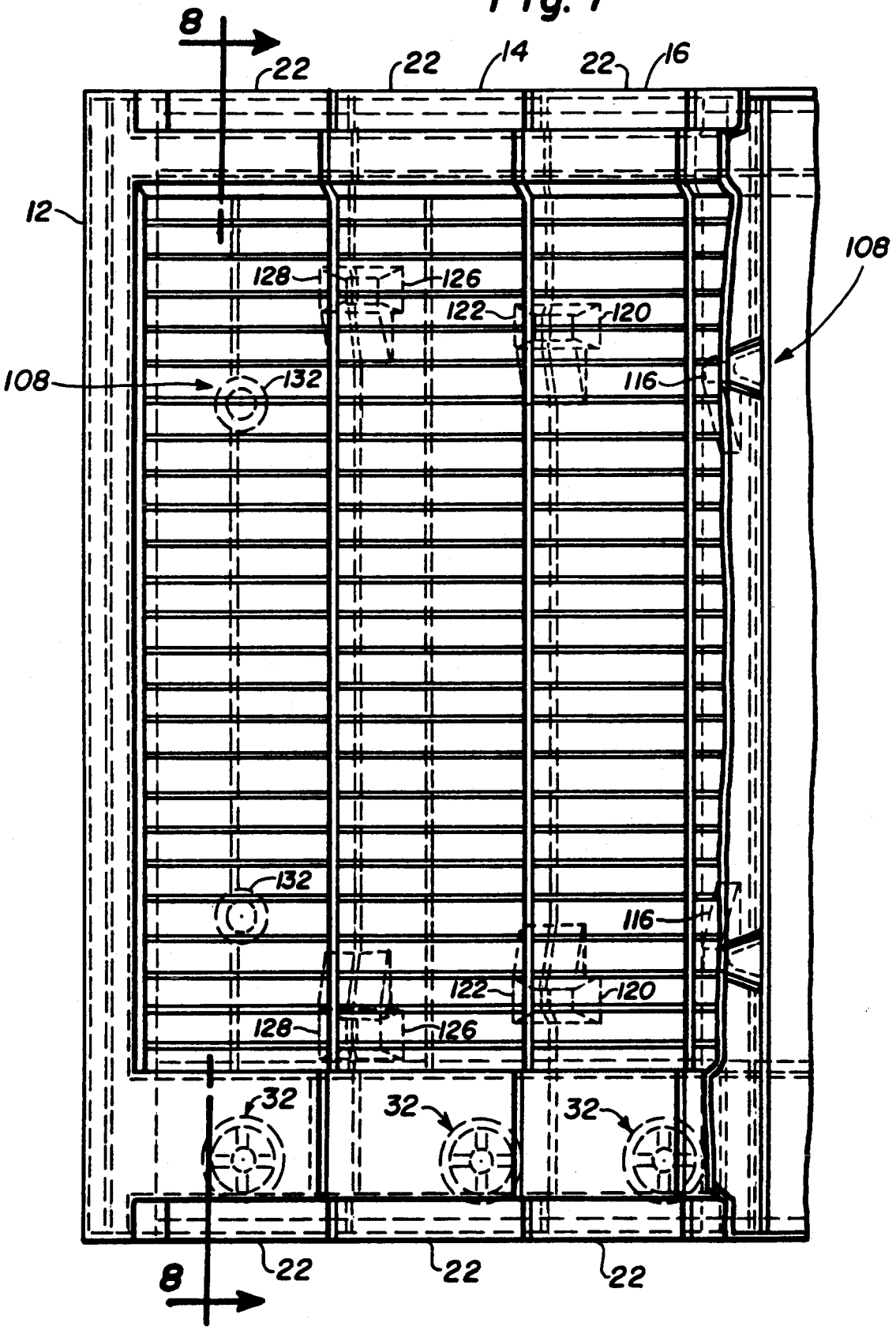
FIG. 7 is a fragmentary view of the apparatus as taken on the line 7—7 of FIG. 3.

FIG. 7 is a fragmentary view of the apparatus 10 as taken on the line 7—7 of FIG. 3. FIG. 7 shows that the pylons 108 are staggered so as to enable each of the cartridges 12, 14, 16 to mount on the cartridges support cover 68 in only one position. FIGS. 1, 2 and 7 show the handles 22 on each of the cartridges for two handed manipulation. FIG. 7 further shows the position of the chicken feeder caps 32 in relation to the cartridges 12, 14 and 16.

Figure 8:
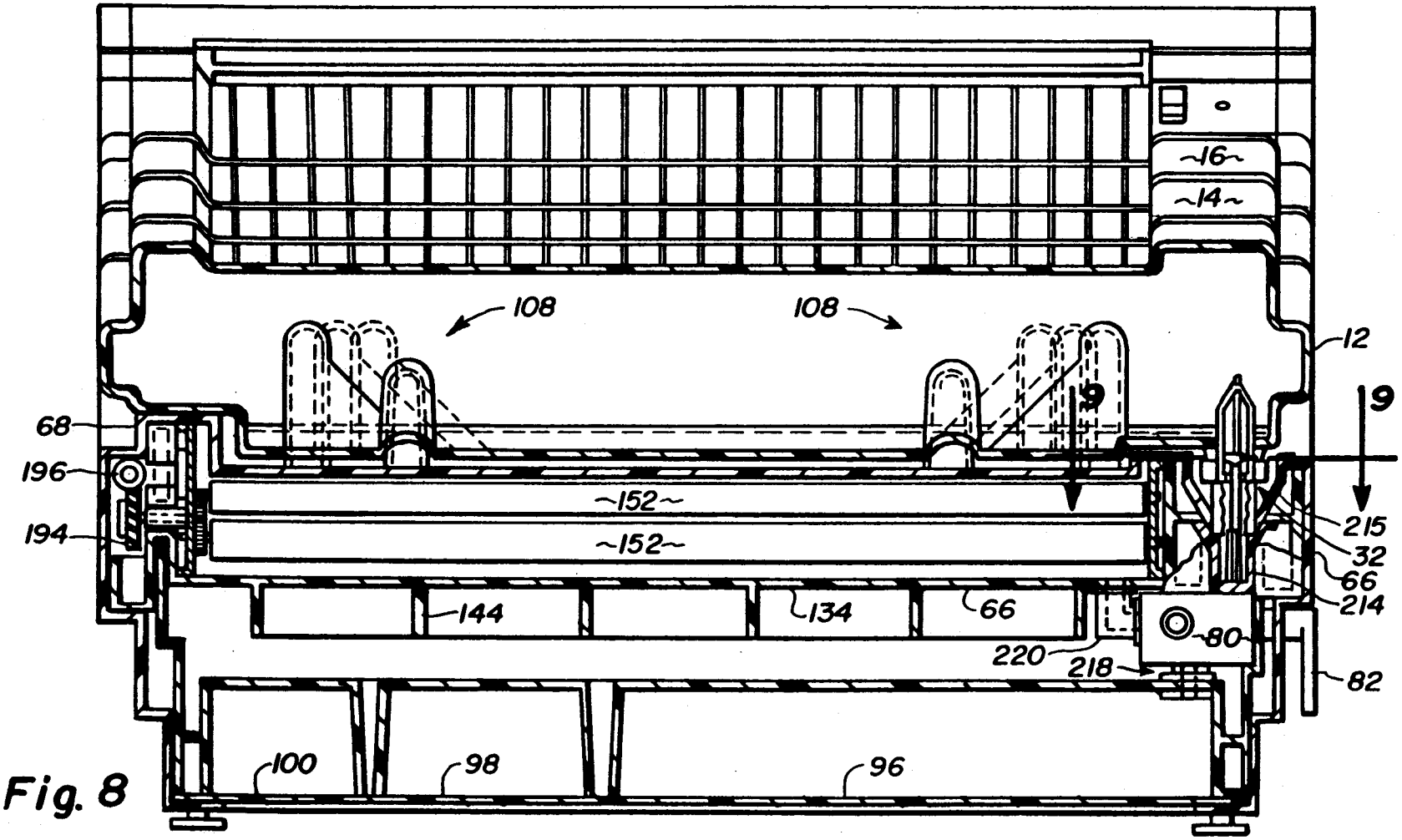
FIG. 8 is a sectional view through the apparatus taken on the line 8—8 of FIG. 7.

FIG. 8 is a sectional view through the apparatus 10 taken on the line 8—8 of FIG. 7. FIG. 8 shows the staggered relationship of the cartridge locating pylons 108 across the width of the apparatus 10. FIG. 8 shows one of the chicken feeder caps 32 connected to the developer cartridge 12. The chicken feeder cap 32 includes a chicken feeder valve that controls the flow of developer solution from the developer cartridge 12 to a cup or cavity 214 defined by the processor tray 66. The chicken feeder cap 32 extends through a skirt portion 215 in the cartridge support and tank cover 68. The cup 214 is connected to and is in fluid communication with one of the 3-way valves 80 which itself is connected by a line 218 to the waste developer compartment 96 of the drain cartridge 74 and by another line 220 to the developer tank 134.

Figure 9:
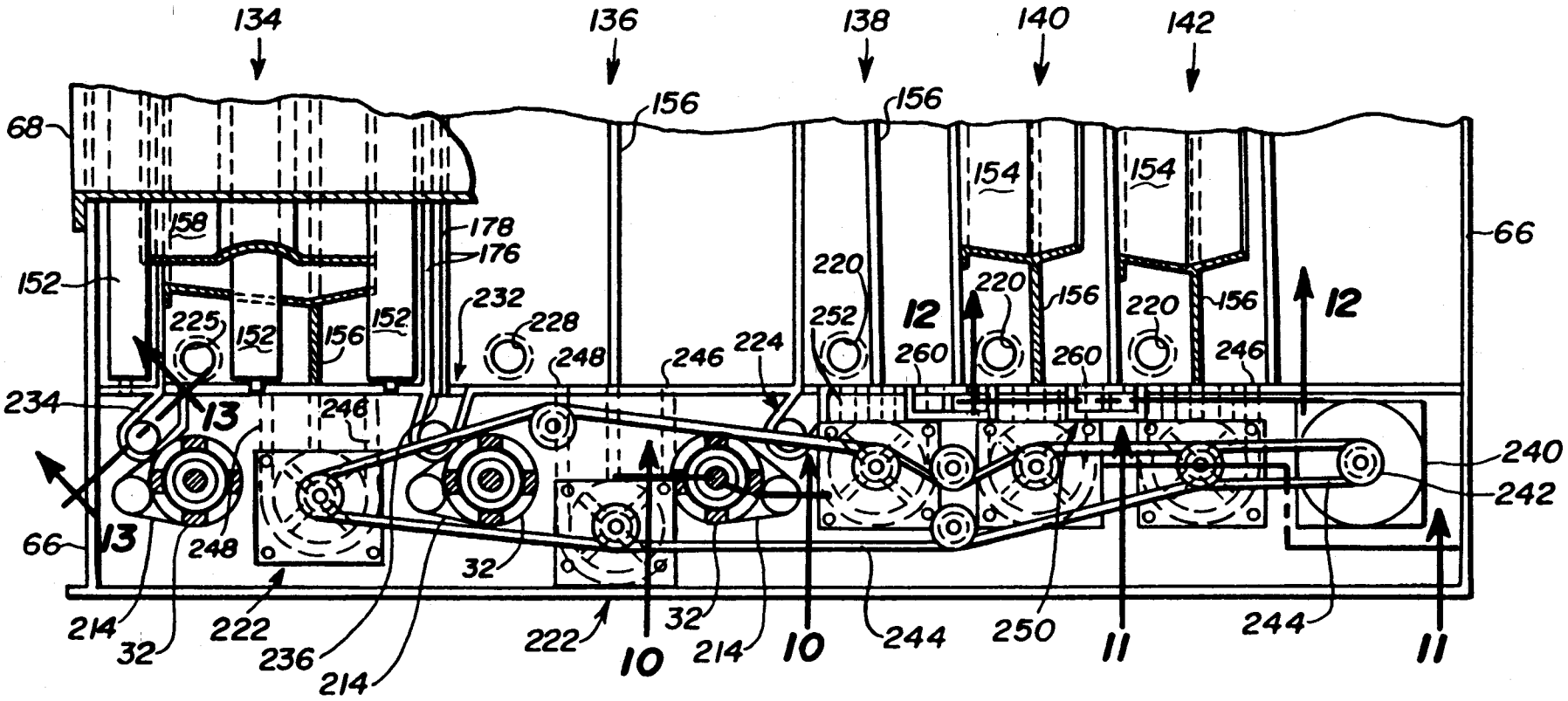
FIG. 9 is a horizontal sectional view taken generally on the line 9—9 of FIG. 8.

FIG. 9 is a horizontal sectional view taken generally on the line 9—9 of FIG. 8. FIG. 9 shows the tanks 134, 136, 138, 140, 142, the chicken feeder caps 32 connected to the cartridges 12, 14, 16, a circulation pump rotor assembly 222 associated with each of the tanks 134, 136, 138, 140, 142, and an overflow drain or outlet 224 from each of the tanks 134, 136, 138, 140, 142.

A first one of the caps 32 provides developer solution from the developer cartridge 12 to a first one of the cups 214. A first passage or line marked with an "X" in FIG. 9 is connected to the first cup 214 and provides developer solution from the first cup 214 to the developer tank 134 through a port 225 in the bottom of the developer tank 134. A second one of the caps 32 provides fixer solution from the fixer cartridge 14 to a second one the cups 214. A second passage or line marked with a "Y" in FIG. 9 is connected to the second cup 214 and provides fixer solution from the second cup 214 to the fixer tank 136 through a port 228 in the bottom of the fixer tank 136. A third one of the caps 32 provides wash solution from the wash cartridge 16 to a third one of the cups 214. A third passage or line marked with a "Z" in FIG. 9 is connected to the third cup 214 and provides wash solution from the third cup 214 to ports 220 in the bottom of the first, second and third wash tanks 138, 140 and 142, respectively.

The overflow drains or outlets 224 comprise overflow weirs 232 and drain passages or lines 234. The weirs 232 are lowered portions of walls defining the developer tank 134, the fixer tank 136 and each of the wash tanks 138, 140, 142. The channel 178 between the two walls 176 separating the developer tank 134 and the fixer tank 136 also has a weir 236 in a wall defining the channel 178. Solution that flows over the overflow weir 232 in the wall of the developer tank 134 overflows into the drain passage or line 234 which in turn is connected to the developer compartment 96 of the drain cartridge 74. Solution that flows over the overflow weir 232 in the wall of the fixer tank 136 overflows into the drain passage or line 234 which in turn is connected to the fixer compartment 98 of the drain cartridge 74. Solution that flows over the overflow weir 232 in the first wash tank 138 overflows into the drain passage or line 234 which in turn is connected to the wash compartment 100 of the drain cartridge 74. Solution that may overflow from either the developer tank 134 or the fixer tank 136 into the channel 178 can flow over weir 236 into the line 234 connected to the fixer compartment 98 of the drain cartridge 74.

A motor 240 is connected by pulleys 242 and belts 244 to drive each of the circulation pump rotor assemblies 222. The rotor assemblies 222 can be rotated clockwise or counterclockwise.

The rotor assemblies 222 associated with the developer tank 134, the fixer tank 136 and the third wash tank 142 can draw solution from their respective tanks either through conduits 246 (if clockwise) or 248 (if counterclockwise). The conduits 246 and 248 can be passages molded in the processing tray 66. The rotor assemblies 222 force the solution out the other of the conduits or passages 246 or 248 back to the respective tank. The rotor assemblies 222 cause the solution in the tanks 134, 136, 138, 140, 142 to circulate between the upper and lower film guides 154, 158, 160, 162 and around the baffles 156 extending into the tanks 134, 136, 138, 140, 142.

If driven clockwise in FIG. 9, the rotor assemblies 222 associated with the first wash tank 138 and the second wash tank 140 will draw wash solution that overflows from the next wash tank over its weir 232 through an inlet conduit or passage 250 molded in the processing tray 66. Then they will force the wash solution out output conduits or passages 252 molded in the processing tray 66 into their respective wash tank 138 or 140. More specifically, solution that overflows from the third wash tank 142 over its weir 232 flows into a first overflow cavity or well 254. Another or a second weir 256 permits solution in the first overflow well 254 to overflow into a second overflow well 258. When the rotor assemblies 222 are driven clockwise, the inlet passage 250 of the rotor assembly 222 associated with the second wash tank 140 is connected to receive wash solution from the second overflow well 258. Further, the second overflow well 258 does not permit wash solution to pass from it to the second wash tank 140 unless it goes through the rotor assembly 222. A similar arrangement exists between the first wash tank 138 and the second wash tank 140 as seen in FIG. 9.

On the other hand, if the rotor assemblies 222 are driven counterclockwise, the rotor assemblies 222 associated with the first and second wash tanks 138, 140 draw wash solution through the passages 252 from their respective tanks 138, 140 and force the solution through the passages 250 and the second overflow wells 258 which must then directly communicate with the respective tanks through ports 260.

FIG. 10 is a detailed sectional view taken on the line 10—10 of FIG. 9 showing the details of one of the chicken feeder caps 32. FIG. 10 shows the cap 32 connected to the wash cartridge 16 by mating threaded portions 262. A seal 264 may be used to make the connection between the cartridge 16 and the cap 32 fluid tight. The cap 32 comprises a cage 266 connected to a first end of a cylindrical housing 268 having a valve seat 270 at the first end of the housing 268. A valve stem 272 extends through the housing 268, the valve seat 270 and a guide hole 274 in the cage 266. A chicken feeder valve seal 276 is positioned in the cage 266 and connected to the valve stem 272. A compression spring 278 is positioned around the valve stem 272 between the cage 266 and the valve seal 276 to bias the valve seal 276 towards the valve seat 270. When the cap 32 is screwed on the cartridge 16 and the valve seal 276 is biased onto the valve seat 270, the cartridge 16 is sealed closed permitting the cartridge 16 filled with solution to be held in any orientation without leaking.

When the cartridge 16 with the cap 32 screwed on it is mounted on its unique cartridge receiving position on the cartridge support and tank cover 68, the second end of the cylindrical housing 268 extends through one of the skirt portions 216 in the cartridge support and tank cover 68 into one of the cups 214 in the processing tray 66. A valve actuator 280 is connected to the cup 214 and is positioned to push the valve stem 272 up when the cartridge 16 is set on its cartridge receiving position. This permits solution in the cartridge 16 to flow through windows 282 into the cage 266, through the housing 268 into the cup 214 until solution rises about to the fluid level indicated by the number 284 in FIG. 10 controlled by the position of the lower end of the cylindrical housing 268 in the cup 214.

FIG. 11 is a sectional view taken on the line 11—11 of FIG. 9 showing the details of one of the rotor assemblies 222. Each of the rotor assemblies 222 comprise a paddle wheel or rotor 286 connected to a lower end of a shaft 288. The shaft 288 is rotatably held in a bearing portion 290 of a housing 292. The rotor 286 extends into a cavity defined by a container 294 made in the processing tray 66, the container 294 being connected to the tank 142 by the passages 246 and 248. A cylindrical portion 296 of the housing 292 may extend within the cavity around the rotor 286 to restrict the volume of solution pumped by the rotor 286. The housing 292 may be connected to the processing tray 66 by any means, such as with nut and bolt assemblies 298. Two of the pulleys 242 are connected to an upper end of the rotor shaft 288. One of the belts 244 connects one of the pulleys 242 to the motor 240. Another one of the belts 244 connects the other pulley 242 to pulleys 242 on shafts 288 of the other rotor assemblies 222.

FIG. 12 is a schematic of a sectional view taken on the line 12—12 of FIG. 9. FIG. 12 shows the overflow weirs 232, 256 between the second and third wash tanks 140 and 142. It shows the first overflow well 254, the second overflow weir 256, the second overflow well 258 and the passage 250 between the third wash tank 142 and the container 294 for the rotor 286 for circulating wash solution in the second wash tank 140. FIG. 12 shows the port 260 communicating between the second overflow well 258 and the second wash tank 140. As mentioned before this port 260 only exists when the rotor assemblies 222 as shown in FIG. 9 are driven counterclockwise.

FIGS. 9 and 12 best illustrate a wash system in accordance with the present invention. The wash system comprises a plurality of the wash stations 138, 140 142 including a first and a last station 138 and 142, respectively, and means for directing 232, 254, 256, 258 wash solution through the plurality of wash stations 138, 140, 142 in a countercurrent arrangement to the direction of material transport for washing the material.

FIG. 13 is a sectional view taken on the line 13—13 of FIG. 9. If shows the details of one of the overflow drains or outlets 224 comprising an overflow weir 232 and a drain passage 234.

Figures 14A, 14B:
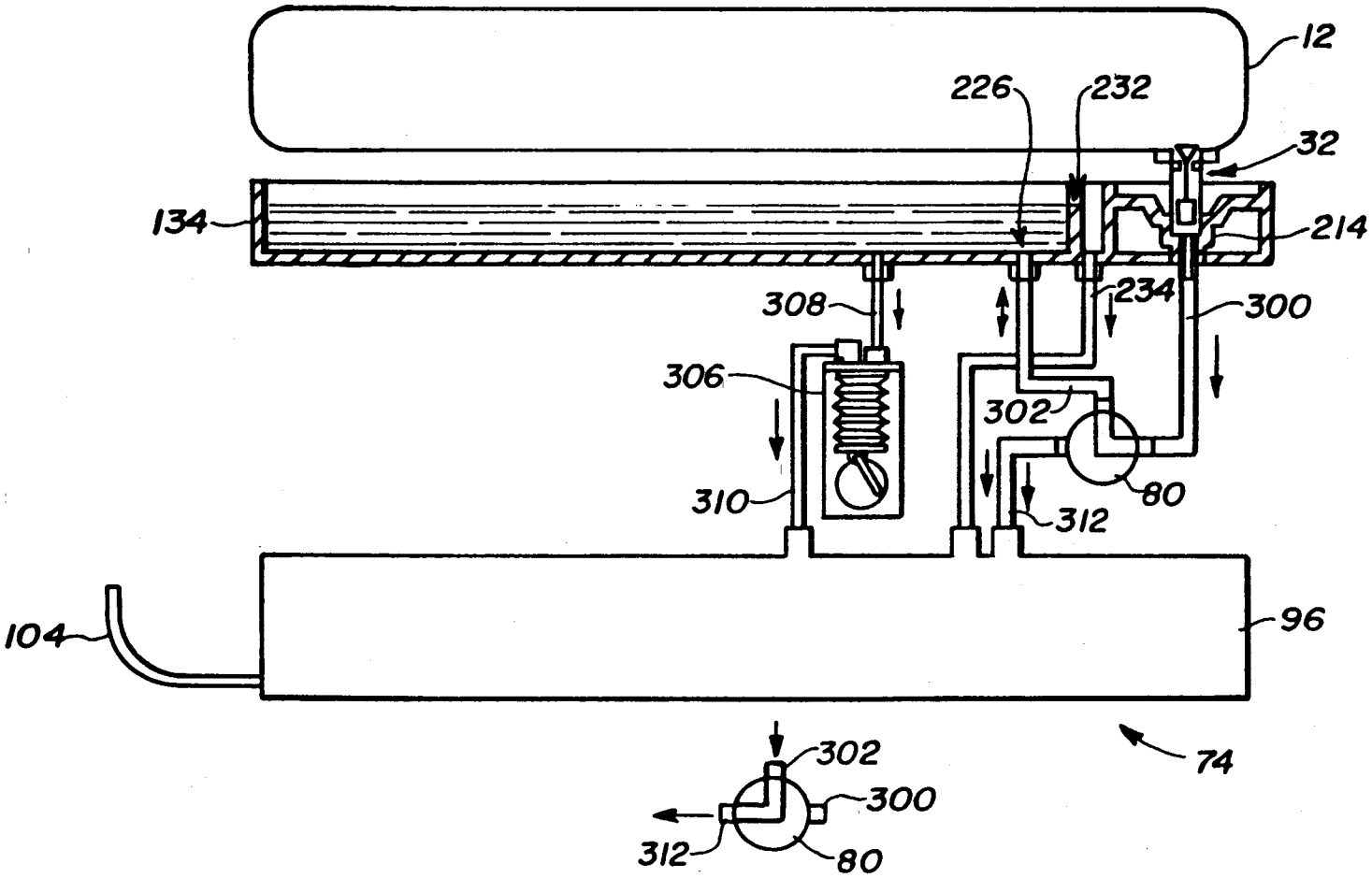
FIG. 14*a* is a schematic illustration of a preferred fluid flow system for developer solution and fixer solution for the apparatus of the present invention.
FIG. 14*b* illustrates the position of the 3-way valve in the schematic of FIG. 14*a* when the developer tank is being drained.

FIG. 14*a* is a schematic illustration of a first preferred embodiment for the fluid flow through the apparatus 10 for developer solution and fixer solution. FIG. 14*a* illustrates a preferred embodiment of means for holding and supplying replenishment developer solution to the first holding means 134. For the purposes of this discussion, the fluid flow of the developer solution will be described, but it is the same for the fixer solution. To fill the developer tank 134 with developer solution from the developer cartridge 12, the 3-way valve 80 is positioned as illustrated in FIG. 14*a*. This permits developer solution to flow by gravity from the developer cartridge 12 through the cap 32 into the cup 214 through a line 300, the 3-way valve 80 and then through a line 302 connected to the port 226 in the developer tank 134. The developer solution will flow into the developer tank 134 in this manner until it reaches the appropriate level controlled by the position of the lower end of the corresponding cylindrical housing 268 in the cup 214.

When processing or developing material through the apparatus 10, the 3-way valve 80 is also as depicted in FIG. 14*a*. Further, a material sensor (not depicted) positioned near the feed slot 48 sends a signal indicating that material is being fed into the apparatus 10 which results in a replenishment pump 306 being activated. The pump 306 is connected by a line 308 to draw solution from the developer tank 134. The pump 306 exhausts the solution through a line 310 connected to the developer compartment 96 of the drain cartridge 74. When solution is being withdrawn from the tank 134 by the replenishment pump 306 or other means, replenishment solution is automatically fed into the tank 134 by gravity through the 3-way valve 80.

To drain the developer tank 134, the 3-way valve 80 is adjusted to the position depicted in FIG. 14*b*. In this position, solution in the tank 134 drains through the line 302, the 3-way valve 80 and a line 312 connected to the developer compartment 96 of the drain cartridge 74.

FIG. 14*a* further shows the overflow weir 232 from the developer tank 134 and the drain line 234 to the developer compartment 96 of the drain cartridge 74. It also shows the flexible line 104 for draining the developer compartment 96.

Figure 15A:
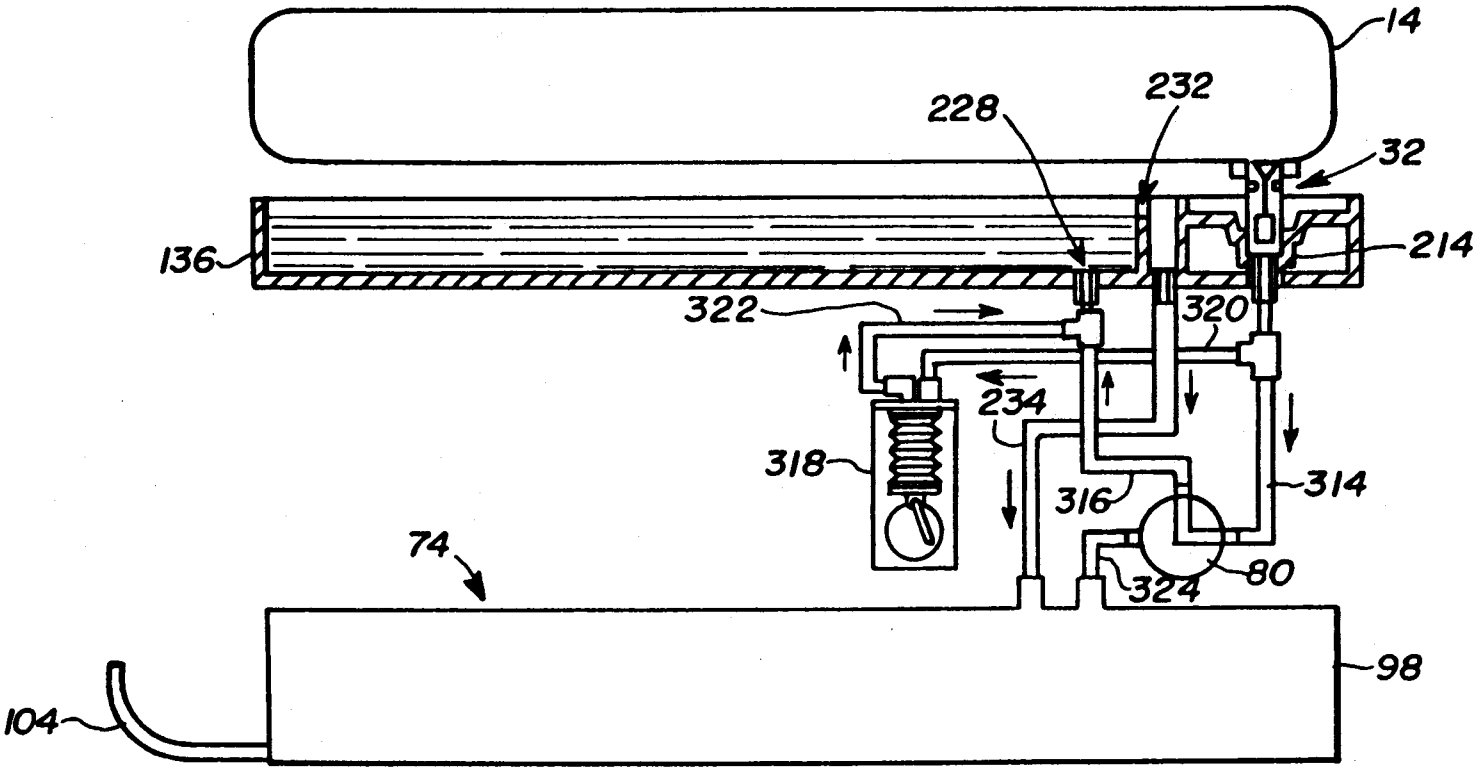
FIG. 15*a* is a schematic illustration of an alternative preferred fluid flow system for developer solution and fixer solution for the apparatus of the present invention.

FIG. 15*a* is a schematic illustration of a second preferred embodiment for the fluid flow through the apparatus 10 for developer solution and fixer solution. FIG. 14*a* illustrates a preferred embodiment of means for holding and supplying replenishment fixer solution to the second holding means 136. For the purposes of this discussion, the fluid flow of the fixer solution will be discussed, but it is the same for the developer solution. To fill the fixer tank 136 with fixer solution from the fixer cartridge 14, one of the 3-way valves 80 is positioned as illustrated in FIG. 15*a*. This permits fixer solution to flow by gravity from the fixer cartridge 14 through the cap 32 into the cup 214 through a line 314, the 3-way valve 80 and then through a line 316 connected to the port 228 in the fixer tank 136. The fixer solution will flow into the fixer tank 136 in this manner until it reaches the same level indicated by the number 284 in FIG. 10 controlled by the position of the lower end of the cylindrical housing 268.

Figure 15B:
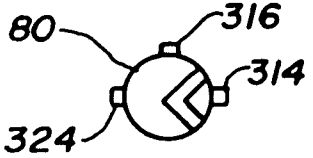
FIG. 15*b* illustrates the position of the 3-way valve in the schematic of FIG. 15*a* when the apparatus is processing material.

In operation, when processing material through the apparatus 10, the 3-way valve 80 is turned to the position depicted in FIG. 15*b*. In this embodiment, when material is fed into the feed slot 48, the material sensor (not depicted) sends a signal to activate a replenishment pump 318. The pump 318 is connected by a line 320 to draw solution from the line 314 connected to the cup 214. The pump 318 pumps the solution through a line 322 connected to the line 316 to the fixer tank 136. Here, fixer solution overflows from the fixer tank 136 over the weir 232 through the drain line 234 into the fixer compartment 98 of the drain cartridge 74.

Figure 15C:
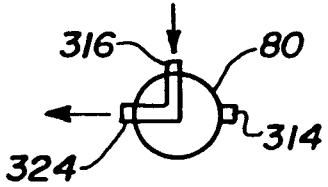
FIG. 15*c* illustrates the position of the 3-way valve in FIG. 15*a* when the fixer tank is draining.

To drain the fixer tank 136, the 3-way valve 80 is adjusted to the position depicted in FIG. 15*c*. In this position, solution in the fixer tank 136 drains through the line 316, the 3-way valve 80 and a line 324 connected to the fixer compartment 98 of the drain cartridge 74.

Developer and fixer is replenished at less than about 18 milliliters of developer solution per square foot (193.8 milliliters per square meter) of film or paper and less than about 18 milliliters of fixer solution per square foot of film or paper to provide archival film quality, which is approximately 0.1 to 0.4 of normal rates.

Figures 16A, 16B, 16C:
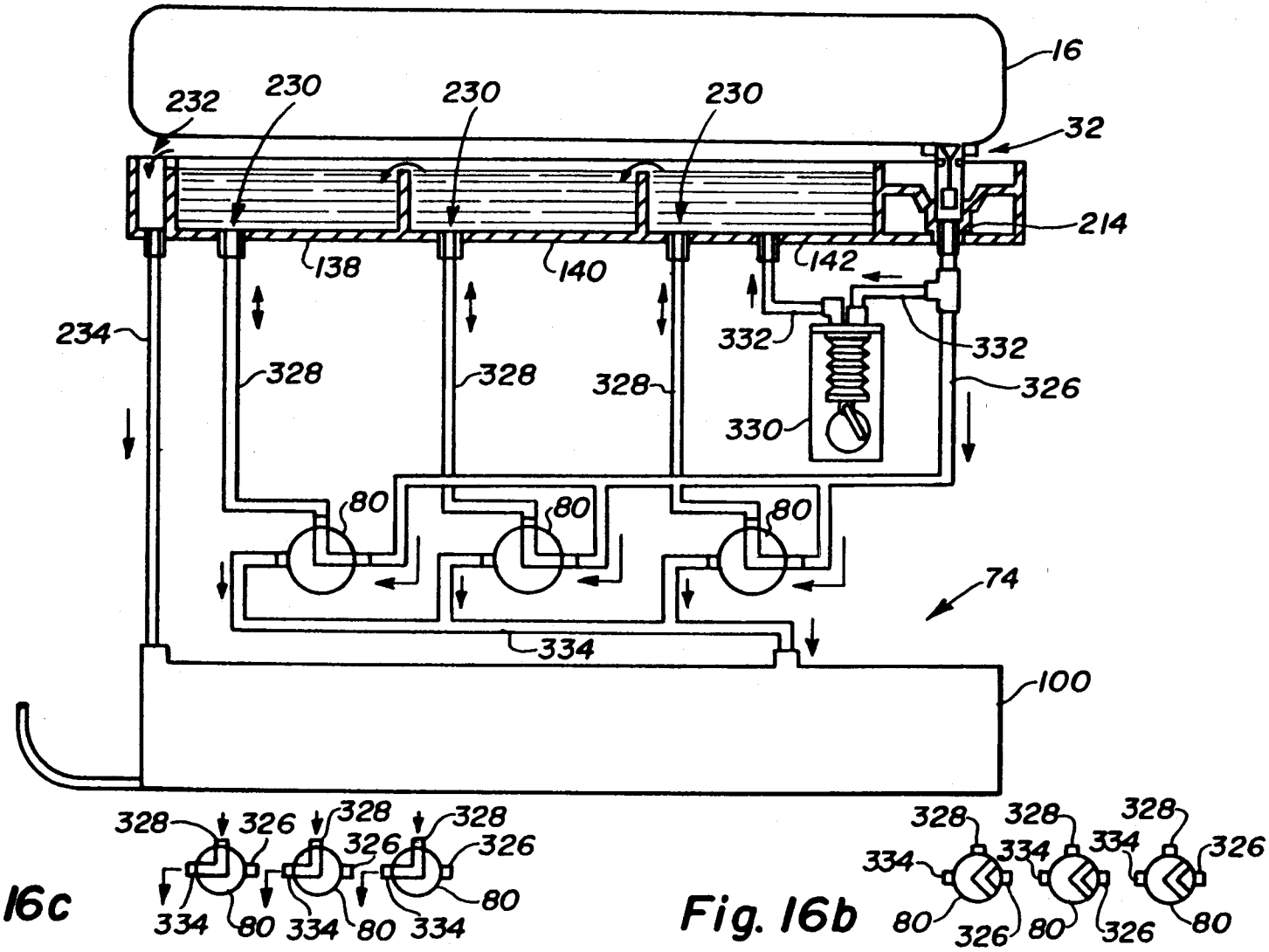
FIG. 16*a* is a schematic illustration of a preferred fluid flow system for wash solution for the apparatus of the present invention.
FIG. 16*b* illustrates the position of the 3-way valves in FIG. 16*a* when the apparatus is processing material.
FIG. 16*c* illustrates the position of the 3-way valves in FIG. 16*a* when the first, second and third wash tanks are draining.

FIG. 16*a* is a schematic illustration of a preferred embodiment for the fluid flow through the apparatus 10 for the wash solution. FIG. 16*a* illustrates a preferred embodiment of means for holding and supplying replenishment wash solution to the plurality of stations 138, 140, 142 of the wash system.

To fill the first, second and third wash tanks 138, 140, 142 with wash solution from the wash cartridge 16, three of the 3-way valves 80 are positioned as depicted in FIG. 16*a*. This permits wash solution to flow by gravity from the wash cartridge 16 through the cap 32 into the cup 214 through a line 326 connected to each of the three 3-way valves 80, the 3-way valves 80, and lines 328 connected between the 3-way valves 80 and ports 230 in the wash tanks 138, 140, 142. The wash solution will flow into the wash tanks 138, 140, 142 in this manner until it reaches the same level in each of the wash tanks 138, 140, 142 controlled by the position of the lower end of the corresponding cylindrical housing 268.

In operation, when processing material through the apparatus 10, the 3-way valves 80 are turned to the position depicted in FIG. 16*b*. When material is fed into the feed slot 48, the material sensor (not depicted) sends a signal to turn on a replenishment pump 330. The replenishment pumps 306, 318 and 330 can be parts of a pump system driven by the pump 172. The pump 330 is connected by lines 332 to the line 326 and the third wash tank 142 such that wash solution is drawn from the cup 214 through the lines 326 and 332, the pump 330, the line 332 into the third wash tank 142.

The curved arrows over the walls between the tanks 138, 140, 142 symbolize the flow of wash solution over the first and second weirs 232, 256 from the third wash tank 142 to the second wash tank 140 and from the second wash tank 140 to the first wash tank 138 previously described in reference to FIGS. 9 and 12. FIG. 16*a* further shows the over flow weir 232 and drain line 234 associated with the first wash tank 138.

To drain the wash tanks 138, 140, 142, the three 3-way valves 80 are positioned as illustrated in FIG. 16*c*. In this position, solution in the tanks 138, 140, 142 drains through the lines 328, the 3-way- valves 80, and line 334 to the wash compartment 100 of the drain cartridge 74.

The low wash water usage process described in copending U.S. patent application Ser. No. 07/316,656 filed on Feb. 28, 1989, assigned to the same assignee as the invention described herein, which is incorporated herein by reference, is practiced in the three wash tank system described herein requiring only no more than about 50 milliliters of water replenishment per square foot (538.2 milliliters per square meter) of film or paper provide archival film quality. Preferably, the wash system of the present invention requires no more than about 40 milliliters of water replenishment per square foot (430.6 milliliters per square meter) of film or paper to provide archival film quality. For the purposes of this disclosure, archival film quality is defined to be less than 7 micrograms per square inch (1.1 micrograms per square centimeter) of residual silver on processed silver halide films and papers and less than 30 micrograms per square inch (4.7 micrograms per square centimeter) of residual thiosulfate on processed silver halide films and papers.

In operation, the processor 10 of the present invention performs a method of processing a sheet or web of photosensitive material comprising: transporting the material through a bath 134 of developer solution, a bath 136 of fixer solution and a plurality of baths 138, 140, 142 of wash solution including a first wash bath 138 and a last wash bath 142; circulating the wash solution through the plurality of baths 138, 140, 142 of wash solution in a countercurrent arrangement to the direction of material transport; and supplying replenishment wash solution to the last wash bath 142 such that the volume of replenishment wash solution supplied comprises no more than about 50 milliliters per square foot of material processed. As noted before, preferably, the wash system of the present invention requires no more than about 40 milliliters of water replenishment per square foot (430.6 milliliters per square meter) of film or paper to provide archival film quality.

The photosensitive materials that can be processed by the present invention may be any which are well-known for imaging and reproduction in fields such as graphic arts, printing, medical, industrial and information systems. These materials and compositions may be of varied content and be negative and/or positive working. Further, substrates for the photosensitive materials which may be used in this invention are papers or films composed of various film-forming synthetic resins or high polymers, such as polyamides, polyimides, polyolefins, polyesters, vinyl polymers, and cellulose esters. Most preferred photosensitive materials suitable for use in this invention are sold by E. I. du Pont de Nemours and Company (hereafter referred to as Du Pont), Wilmington, Del. 19898, as Convenience System TM films and papers, such as, for example: Convenience System TM Camera Film, Convenience System TM Bright Light Paper, and Convenience System TM Helium-Neon PTS Film.

The assembly is designed to process films and papers having the following characteristics. Film can have a thickness of 0.003 to 0.007 inch polyester base. Paper can be from 0.0025 to 0.007 inch thick. The film or paper can be from 3 to 22 inches (7.6 centimeters through 55.9 centimeters) wide and from 10 inches to 15 feet long.

Developer solutions which are formulated for rapid processing conditions are suitable for use in this invention and are conventional in the art. Rapid processing is understood by one skilled in the art as high-energy processing primarily in order to reduce throughput time in the the processor. Suitable developing solutions are, for example, Cronatype TM Imagesetting Developer (CID) and High Stability Developer (HSD). The most preferred developer is Convenience System TM Developer. These developer solutions are commercially available from Du Pont.

Fixing solutions which are formulated for rapid processing conditions are suitable for use in this invention and are conventional in the art. Suitable fixers are, for example, Du Pont Liquid Fixer (DLF) and Medical X-ray Fixer (XMF). Optionally, a hardener solution may be incorporated into the fixing solution. The most preferred fixer is Convenience System TM Fixer, which is also commercially available from Du Pont.

The wash solution can be water.

Thus, the processor 10 of the present invention is a compact, 22 inch wide capacity, table top, photographic film and paper processor 10 that does not require the water and drain services usually necessary for a conventional processor. The reduced amount of replenishment and effluent of developer, fixer and water along with limited power requirements allow this unit to be in an office environment versus the usual laboratory or industrial environment. In this regard, the apparatus 10 has a plan view no larger than 30 inches (0.762 meters) by 33 inches (0.838 meters). The processor 10 consumes less solutions and generates less effluent than any known processor 10. The pre-mixed chemistry cartridges 12, 14, 16 and waste handling methods eliminate chemical mixing and disposal methods currently required.

The processor 10 is also preferably able to process film or paper at nominal conditions within 20 minutes of startup from a nominal ambient temperature of 70° F.

Substantially all operator and maintenance functions, including all film and chemistry loading and unloading and normal cleaning, can be performed from the front of the processor 10 allowing the processor 10 to be installed in a limited access area. The left and rear of the processor 10 can be against obstructions and the right side can be within about 6 inches (15.2 centimeters) of an obstruction.

Many parts have been designed to have muliple functions. For instance, the chemistry replenishment cartridges 12, 14, 16 also form part of the exterior or housing 18, act as a receiving tray 20 for processed films and act as a level indicator device to monitor the need for additional solutions and draining of effluent. The film guides 154, 160, 162, 164 and oxidation covers 158 are integrated together to provide more effective oxidation and evaporation barriers. Three effluent compartments 96, 98, 100 are formed in one part 74, function as a tension member for the processor housing 18 and acts as a solution manifold for connections to the processing tray 66.

Visual monitoring of replenishment and effluent solution volumes is possible from the operator feed position that key or prompt processor operations such as replacement of solution cartridges 12, 14, 16, draining of waste compartments 96, 98, 100 and cleaning.

All solutions are contained within the processor 10, from fresh through spent stages, thus reducing and minimizing environmental and human contact.

Those skilled in the art, having the benefit of the teachings of the present invention as hereinabove set forth, can effect numerous modifications thereto. These modifications are to be construed as being encompassed within the scope of the present invention as set forth in the appended claims.

What is claimed is:

1. An apparatus for processing a sheet or web of photosensitive material comprising:

means for holding process developer solution;

means for holding process fixer solution;

a wash system comprising a plurality of wash stations including a first and a last station and means for directing wash solution through the plurality of wash stations in a countercurrent arrangement to the direction of material transport for washing the material;

a dryer for drying the material;

means for transporting the material in order through the process developer solution when the process developer solution is in the first holding means, the process fixer solution when the process fixer solution is in the second holding means, the process wash solution when the process wash solution is in the plurality of wash stations and the dryer;

first means for holding and supplying replenishment developer solution to the first holding means;

second means for holding and supplying replenishment fixer solution to the second holding means; and third means for holding and supplying replenishment wash solution to the last station of the wash system, wherein the volume of replenishment wash solution supplied to the wash system comprises no more than about 50 milliliters per square foot (538.2 milliliters per square meter) of material processed by the apparatus.

2. The apparatus of claim 1, wherein the wash system is adapted to provide less than 7 micrograms per square inch (1.1 micrograms per square centimeter) of residual silver on processed silver halide film or paper and less than 30 micrograms per square inch (4.7 micrograms per square centimeter) of residual thiosulfate on processed silver halide film or paper.

3. A method of processing a sheet or web of photosensitive material comprising:

transporting the material through a bath of developer solution, a bath of fixer solution and a plurality of baths of wash solution including a first wash bath and a last wash bath;

circulating the wash solution through the plurality of baths of wash solution in a countercurrent arrangement to the direction of material transport; and supplying replenishment wash solution to one or more of the plurality of baths of wash solution such that the volume of replenishment wash solution supplied comprises no more than about 50 milliliters per square foot (538.2 millilieters per square meter) of material processed.

4. The method of claim 3, wherein the material is silver halide film or paper and transporting the film or paper through the baths provides less than 7 micrograms per square inch (1.1 micrograms per square centimeter) of residual silver on processed film or paper and less than 30 micrograms per square inch (4.7 micrograms per square centimeter) of residual thiosulfate on processed film or paper.

5. An apparatus for processing a sheet or web of photosensitive material comprising:

first means for holding process developer solution;

second means for holding process fixer solution;

a wash system comprising a plurality of wash stations including a first and a last station and means for directing wash solution through the plurality of wash stations in a countercurrent arrangement to the direction of material transport for washing the material;

a dryer for drying the material;

means for transporting the material in order through the process developer solution when the process developer solution is in the first holding means, the process fixer solution when the process fixer solution is in the second holding means, the process wash solution when the process wash solution is in the plurality of wash stations and the dryer;

first means for holding and supplying replenishment developer solution to the first holding means;

second means for holding and supplying replenishment fixer solution to the second holding means;

third means for holding and supplying replenishment wash solution to the last station of the wash system;

means for heating the process developer solution when the process developer solution is in the first holding means, the process fixer solution when the process fixer solution is in the second holding means, and the process wash solution when the process wash solution is in the plurality of wash stations; and the first, second and third holding and supplying means positioned above at least one of the first holding means, the second holding means and the wash system to preheat the replenishment solutions by radiant heat from the process solutions when they are heated by the heating means.

6. An apparatus for processing a sheet or web of photosensitive material comprising:

first means for holding process developer solution;

second means for holding process fixer solution;

a wash system comprising a plurality of wash stations including a first and a last station and means for directing wash solution through the plurality of wash stations in a countercurrent arrangement to the direction of material transport for washing the material;

a dryer for drying the material;

means for transporting the material in order through the process developer solution when the process developer solution is in the first holding means, the process fixer solution when the process fixer solution is in the second holding means, the process wash solution when the process wash solution is in the plurality of wash stations and the dryer;

first means for holding and supplying replenishment developer solution to the first holding means;

second means for holding and supplying replenishment fixer solution to the second holding means;

third means for holding and supplying replenishment wash solution to the last station of the wash system; and means for separately collecting waste developer solution, waste fixer solution and waste wash solution beneath the first process developer solution holding means, the second process fixer solution holding means and the wash system.

7. The apparatus for claim 6, wherein the collecting means comprises three compartments, each of the compartments having an exit port, the apparatus further comprising a drain spout connected to each of the exit ports, the drain spouts having means for monitoring the height of waste solution in the compartments.

8. An apparatus for processing a sheet or web of photosensitive material comprising:

first means for holding process developer solution;

second means for holding process fixer solution;

a wash system comprising a plurality of wash stations including a first and a last station and means for directing wash solution through the plurality of wash stations in a countercurrent arrangement to the direction of material transport for washing the material;

a dryer for drying the material;

means for transporting the material in order through the process developer solution when the process developer solution is in the first holding means, the process fixer solution when the process fixer solution is in the second holding means, the process wash solution when the process wash solution is in the plurality of wash stations and the dryer;

first means for holding and supplying replenishment developer solution to the first holding means;

second means for holding and supplying replenishment fixer solution to the second holding means; and third means for holding and supplying replenishment wash solution to the last station of the wash system, wherein the transporting means transports the material from the dryer through an outlet to a developed material receiving tray comprising a top surface of the first, second and third holding and supplying means.

9. An apparatus for processing a sheet or web of photosensitive material comprising:

first means for holding process developer solution;

second means for holding process fixer solution;

a wash system comprising a plurality of wash stations including a first and a last station and means for directing wash solution through the plurality of wash stations in a countercurrent arrangement to the direction of material transport for washing the material;

a dryer for drying the material;

means for transporting the material in order through the process developer solution when the process developer solution is in the first holding means, the process fixer solution when the process fixer solution is in the second holding means, the process wash solution when the process wash solution is in the plurality of wash stations and the dryer;

first means for holding and supplying replenishment developer solution to the first holding means;

second means for holding and supplying replenishment fixer solution to the second holding means;

third means for holding and supplying replenishment wash solution to the last station of the wash system; and a support for supporting the first, second and third holding and supplying means in respective first, second and third holding and supplying means supported positions, the support having means for aligning and positioning that allows each of the first, second and third holding and supplying means only into its respective supported position.

10. The apparatus of claim 9, wherein the support comprises a plurality of locating protrusions for positioning in indentations in the first, second and third holding and supplying means.

11. The apparatus of claim 10, wherein pairs of the protrusions and corresponding pairs of the the indentations are offset or shaped differently with respect to the other pairs of the protrusions and the indentations to permit each of the holding and supplying means to mount on the support in only one predetermined position.

12. The apparatus of claim 11, wherein at least one of the pairs of the indentations are in each of the holding and supplying means.

13. The apparatus of claim 9, wherein holding and supplying means comprise cartridges that are shaped to be positioned immediately adjacent to at least one of the other of the cartridges for compact packaging.

14. The apparatus of claim 13, wherein each of the cartridges includes two ergonomic handles.

15. An apparatus for processing a sheet or web of photosensitive material comprising:

first means for holding process developer solution;

second means for holding process fixer solution;

a wash system comprising a plurality of wash stations including a first and a last station and means for directing wash solution through the plurality of wash stations in a countercurrent arrangement to the direction of material transport for washing the material;

a dryer for drying the material;

means for transporting the material in order through the process developer solution when the process developer solution is in the first holding means, the process fixer solution when the process fixer solution is in the second holding means, the process wash solution when the process wash solution is in the plurality of wash stations and the dryer;

first means for holding and supplying replenishment developer solution to the first holding means, the first holding and supplying means including a first hand operatable valve handle extending out a first side of the apparatus;

second means for holding and supplying replenishment fixer solution to the second holding means, the second holding and supplying means including a second hand operatable valve handle extending out the first side of the apparatus; and third means for holding and supplying replenishment wash solution to the last station of the wash system, the third holding and supplying means including a third hand operatable valve handle extending out the first side of the apparatus, wherein operator functions including material loading and unloading, replacement of the first, second and third holding and supplying means, removal of waste solutions and normal cleaning can be performed from a front side of the apparatus allowing the functions to be performed while a second side and a rear side of the apparatus are against obstructions and the first side is within about 6 inches (15.2 centimeters) of an obstruction.

16. A liquid replenishment system for supplying replenishment solutions to maintain a plurality of separate process solutions at predetermined levels in a plurality of separate tanks, the system comprising:

a plurality of cartridges for holding a plurality of separate replenishment solutions;

a plurality of means for supplying one of the replenishment solutions to a corresponding one of the plurality of process solutions; and a support for supporting the plurality of cartridges in respective supported positions, the support having means for aligning and positioning that allows each of the plurality of cartridges only into its respective supported position.

17. The system of claim 16, wherein the support comprises a plurality of cartridge locating protrusions for positioning in indentations in the cartridges.

18. The system of claim 17, wherein pairs of the protusions and corresponding pairs of the indentations are offset or shaped differently with respect to the other pairs of the protrusions and the indentations to permit each of the cartridges to mount on the support in only one predetermined cartridge receiving positions.

19. The system of claim 18, wherein at least one of the pairs of the indentations are in each of the cartridges.

20. The system of claim 16, wherein the cartridges are shaped to be positioned immediately adjacent to at least one of the other of the cartridges for compact packaging.

21. The system of claim 16, wherein each of the cartridges includes two ergonomic handles.

22. A wash system for washing chemicals off a sheet or web of material with a wash solution, the system comprising:

first wash tank having a drain;

a second wash tank having a first overflow weir;

means for transporting the material through wash solution in the first tank and then the second wash tank;

means for directing the wash solution in order through the second tank, over the second tank overflow weir, the first tank and the drain; and means for replenishing wash solution to the second tank at no more than about 50 milliliters per square foot (538.2 milliliters per square meter) of material washed.

23. The wash system of claim 22, wherein the chemicals comprise process developer solution and process fixer solution.

24. The wash system of claim 22, wherein the wash solution in the first and second tanks is at the same level when the system is operating.

25. The wash system of claim 22, further comprising:

a first overflow well for receiving solution that flows from the second tank over the first overflow weir, the first overflow well having a second overflow weir;

a second overflow well for receiving solution that flows from the first overflow well over the second overflow weir; and wherein the directing means comprises means for pumping solution from the second overflow weir through the first tank.

26. The wash system of claim 25, wherein the pumping means is adapted to pump solution from the second overflow well through the pumping means into the first tank.

27. The wash system of claim 25, wherein the pumping means is adapted to pump solution from the first tank through the pumping means and then the second overflow well to force solution in the second overflow into the first tank.

* * * * *